US006220807B1

(12) United States Patent
Sorokan

(10) Patent No.: US 6,220,807 B1
(45) Date of Patent: Apr. 24, 2001

(54) TUBULAR HANDLING SYSTEM

(75) Inventor: Ronald S. Sorokan, Sherwood Park (CA)

(73) Assignee: Dreco Energy Services Ltd.

( * ) Notice: Subject to any disclaimer, the term of this patent is extended or adjusted under 35 U.S.C. 154(b) by 0 days.

(21) Appl. No.: 08/854,299

(22) Filed: May 12, 1997

Related U.S. Application Data

(63) Continuation of application No. 08/396,204, filed on Feb. 28, 1995, now abandoned, which is a continuation of application No. 07/932,683, filed on Aug. 20, 1992, now Pat. No. 5,458,454.

(30) Foreign Application Priority Data

Apr. 30, 1992 (CA) ..... 2067697

(51) Int. Cl.[7] ..... E21B 19/14

(52) U.S. Cl. ..... 414/22.62; 414/22.55; 175/85; 166/77.52

(58) Field of Search ..... 414/786, 22.54, 414/22.55, 22.56, 22.57, 22.58, 22.62, 745.8, 738, 910; 166/77.5; 175/52, 85; 173/28; 294/86.4, 90, 104, 102.2, 102.1, 81.6

(56) References Cited

U.S. PATENT DOCUMENTS

| | | | | |
|---|---|---|---|---|
| 3,177,944 | * | 4/1965 | Knighs | 414/22.64 X |
| 3,581,506 | * | 6/1971 | Howard | 175/85 X |
| 3,633,771 | | 1/1972 | Woolslayer et al. . | |
| 3,860,122 | | 1/1975 | Cernosek . | |
| 3,986,618 | | 10/1976 | Woolslayer et al. . | |
| 3,986,619 | | 10/1976 | Woolslayer et al. . | |
| 4,172,684 | | 10/1979 | Jenkins | 414/22 |
| 4,403,666 | | 9/1983 | Willis | 175/85 |
| 4,407,629 | | 10/1983 | Willis | 414/745 |
| 4,492,501 | * | 1/1985 | Haney | 414/22.55 |
| 4,595,066 | * | 6/1986 | Nelmark et al. | 175/85 |
| 4,703,811 | * | 11/1987 | Lam | 175/85 X |
| 4,708,581 | | 11/1987 | Adair | 414/786 |
| 4,759,414 | | 7/1988 | Willis | 175/170 |
| 4,822,230 | | 4/1989 | Slettedal | 414/22.54 |
| 4,834,604 | | 5/1989 | Brittain et al. | 414/22.55 |
| 5,018,588 | * | 5/1991 | Haberer | 175/52 X |
| 5,458,454 | * | 10/1995 | Sorokan | 414/786 |

* cited by examiner

*Primary Examiner*—Stephen T. Gordon
(74) *Attorney, Agent, or Firm*—John Russell Uren

(57) ABSTRACT

Pipe handling apparatus to move tubulars from a horizontal position on a piperack adjacent a well bore to a vertical position over the wall center or mousehole. A bicep arm assembly is pivotally connected to a base plate. A forearm assembly is pivotally attached to the distant end of the bicep arm assembly and a gripper head is pivotally connected to the distant end of the forearm assembly. The bicep arm assembly is mounted to the structure of the drill rig.

5 Claims, 10 Drawing Sheets

TUBULAR HANDLING SYSTEM

CROSS-REFERENCE TO RELATED APPLICATION

This application is a continuation of application Ser. No. 08/396,204 filed Feb. 28, 1995, now abandoned, which was a continuation of application Ser. No. 07/932,683 filed Aug. 20, 1992 which issued to U.S. Pat. No. 5,458,454 (Oct. 17, 1995).

This invention relates to a tubular or pipe handling system and, more particularly, to a pipe handling system which moves the tubulars from a horizontal position on the piperack located adjacent the drill rig to a vertical position over the well centre and which is adapted for drill rigs used in offshore drilling.

BACKGROUND OF THE INVENTION

Conventionally, drill rigs have utilized a cable handling system for transferring a tubular such as drill pipe or casing from a piperack adjacent the well to a mousehole or well bore for connection to a previously transferred tubular or drill string. A cable extends from the drill rig and is attached to the selected pipe or tubular on the pipe rack. The tubular lies in a generally horizontal position, box end forward, such that the box end of the pipe is initially pulled from the pipe rack by the cable up the catwalk of the rig and through the V-door to assume a substantially vertical position above the drill floor. The lower end is then placed into the mousehole or well bore for connection to the previously transferred pipe and the cable is disconnected.

There are disadvantages inherent in the conventional cable handling technique. The manual involvement of attaching the head of a cable to the tubular and the subsequent movement of the pipe during the transfer operation in the vicinity of a worker gives rise to dangerous working conditions and pipe handling is a major source of injuries on a drill rig, particularly in offshore drilling operations. Secondly, pipe and particularly casing, is expensive. As the tubular is transferred from the pipe rack to the drill floor utilising the cable, contact between the tubular and the catwalk or other portions of the rig is made which can cause damage to the tubular and affect the integrity of the connections between successive ones of the tubulars. This is particularly true where casing is involved.

Prior art apparatuses other than cable handling techniques for gripping a drill pipe and transferring the pipe from a horizontal position on the piperack to a vertical position above the drill floor are known. In some of such prior art apparatuses, pipe handling apparatuses provide pipe handling without the necessity of manual interaction in grasping the pipe or transferring the pipe to the rig. One such apparatus is disclosed in U.S. Pat. No. 3,633,771 to Woolslayer et al which teaches a drill string moved by a strongback having hydraulic grasping jaws mounted a distance apart which exceed the length of a single drill pipe. This apparatus is mounted to the drilling platform and is centered in the V-door of the rig.

A second apparatus is that disclosed in U.S. Pat. No. 4,834,604 to Brittain et al. This patent teaches a strongback which is connected to a one-piece boom, the boom being mounted on a base located adjacent the rig and operating directly through the V-door of the rig. The strongback transfers pipe through the V-door to a vertical position and raises or lowers the pipe so that connection between the pipe and the drill string can occur.

Other prior art used to transfer tubulars does not provide the conventional movement of the tubular box end forward and pin end down in the vertical position; that is, the tubular is moved and must be rotated such that the pin end is in a downwardly directed direction for attachment to the drill string. This may necessitate the design of a special structure for the rig or, alternatively, it may require that the rig structure be modified to accommodate the pipe handling system.

A disadvantage with all of the prior art set forth above arises when breakdown of the pipe handling apparatus occurs. In this event, the breakdown may terminate the installation of the drill pipe or casing since the conventional cable handling technique for tubular transfer cannot be used as a backup. The apparatuses utilised may obstruct the catwalk or otherwise require substantial modification to the rig in order to allow conventional cable operation after breakdown.

SUMMARY OF THE INVENTION

According to one aspect of the invention, there is provided a method of moving tubulars from a substantially horizontal position on a pipe rack to a substantially vertical position above the drill floor of a drill rig, comprising the steps of:

(a) simultaneously moving a bicep arm assembly pivotally connected to the structure of a drill rig, a forearm assembly pivotally connected to said bicep arm assembly, and a gripper head assembly pivotally connected to said bicep arm assembly into proximity with said tubular;

(b) grasping said tubular with said gripper head assembly;

(c) transferring said tubular box end forward into a position over the drill floor of said drill rig with said gripper head assembly, said forearm assembly and said bicep arm assembly; and (d) rotating said tubular through approximately ninety (90) degrees from said horizontal to said vertical position during said transfer from said piperack to said vertical position.

According to a further aspect of the invention, there is provided a pipe handling system for a drill rig comprising a bicep arm assembly pivotally connected to a base plate, a forearm assembly pivotally attached to the distant end of said bicep arm assembly, a gripper head pivotally connected to the distant end of said forearm assembly and means for mounting said bicep arm assembly to the structure of a drill rig such that said forearm assembly and said gripper head are operable to move tubulars from a piperack into a position above the drill floor of said drill rig.

According to yet a further aspect of the invention, there is provided a pipe handling system comprising a bicep arm assembly, a forearm assembly pivotally connected to said bicep arm assembly, the longitudinal central axis of said bicep arm assembly being offset from the longitudinal central axis of said forearm assembly such that the plane of movement of said forearm assembly and a gripper head assembly pivotally connected thereto is offset a predetermined distance from the plane of movement of said bicep arm assembly.

According to yet a further aspect of the invention, there is provided a pipe handling system comprising a bicep arm assembly, a forearm assembly pivotally connected to said bicep arm assembly, a gripper head assembly pivotally connected to said forearm assembly and means for mounting said bicep arm assembly to the structure of a drill rig, said mounting means comprising a base plate operable to attach to a base mounting plate connected to said structure of said drill rig, said base plate being operable to move with said bicep arm assembly, said forearm assembly and said gripper head assembly relative to the base mounting plate connected to said drill rig.

According to yet a further aspect of the invention, there is provided a pipe handling system comprising a bicep arm assembly, a forearm assembly pivotally connected to said bicep arm assembly and a gripper head assembly pivotally connected to said forearm assembly for gripping and moving a tubular from a horizontal position on a piperack to a near vertical position above the drill floor of a drill rig, said gripper head assembly being pivotal relative to said forearm assembly about at least two axes thereby allowing said tubular to be inclined slightly when said tubular reaches a position above said drill floor.

According to yet a further aspect of the invention, there is provided a gripper head assembly for a pipe handling system, said gripper head assembly comprising an upper gripper assembly, a taper lock assembly and a clamping assembly operably connected to a lower gripper assembly and means to removably connect said lower gripper assembly to said upper gripper assembly.

BRIEF SUMMARY OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
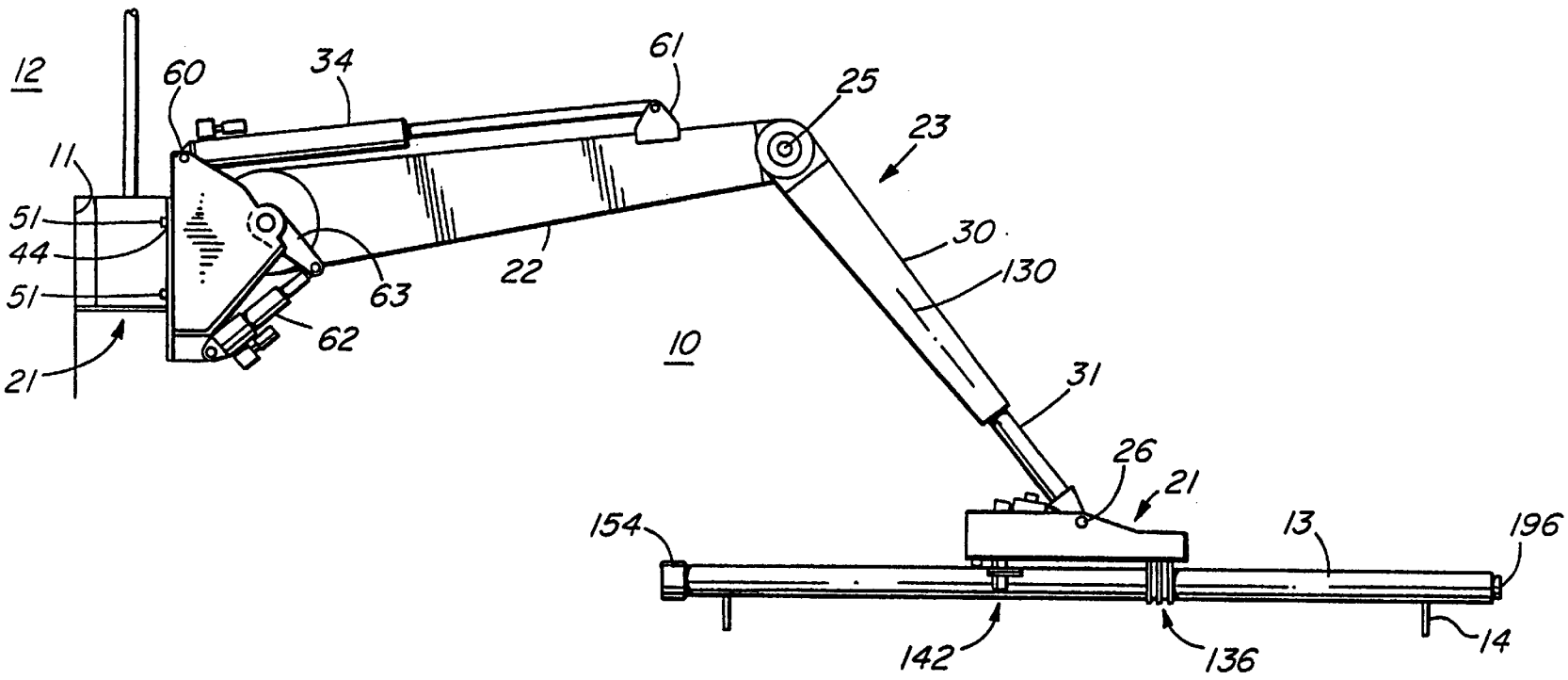
FIG. 1 is a side view of the pipe handling system according to the invention in the process of grasping the tubular and commencing the transfer of the tubular from its horizontal position in the piperack adjacent the well bore.
Figure 2:
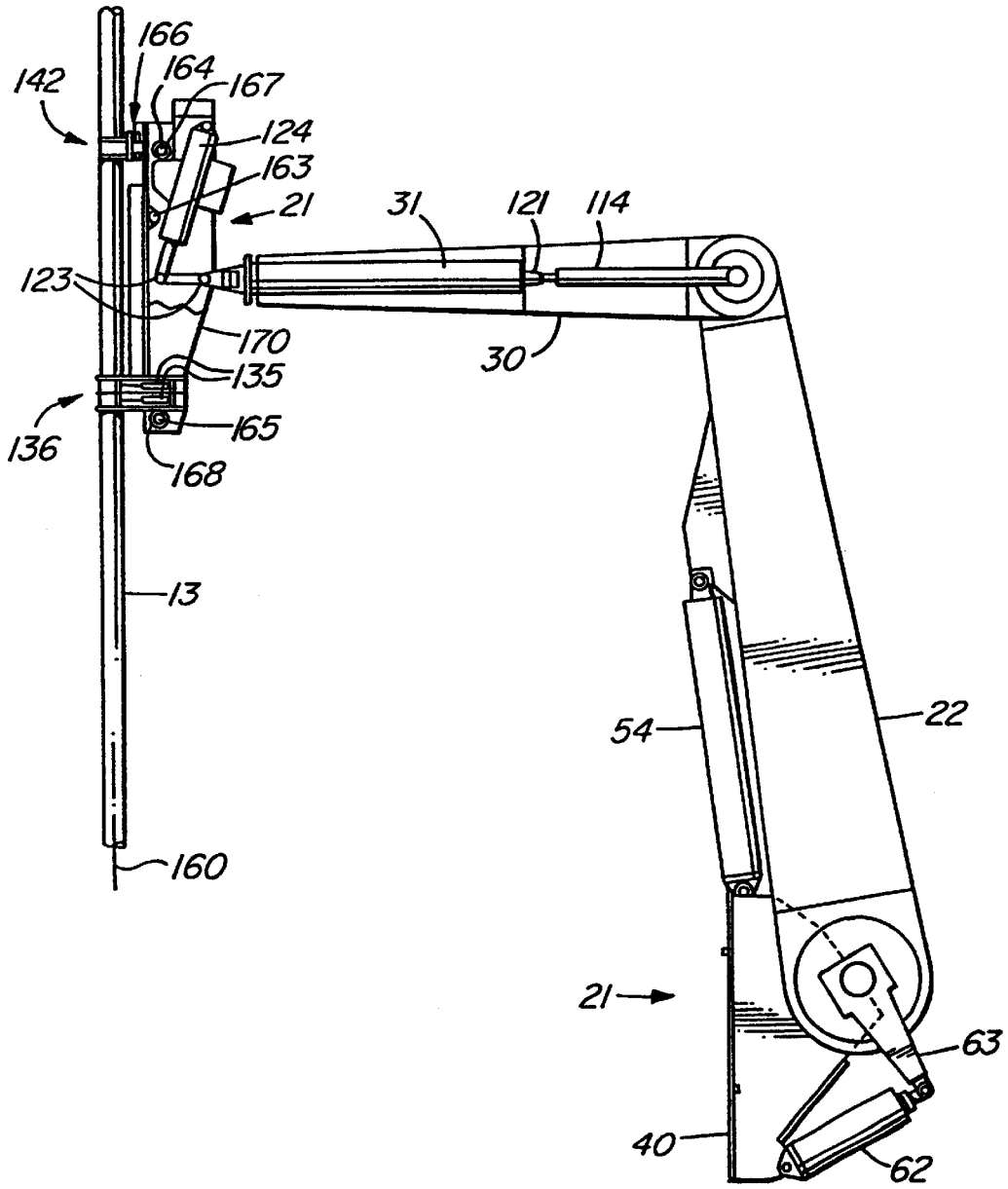
FIG. 2 is a side view of the pipe handling system of FIG. 1 with the tubular in its vertical position over the centre of the well bore and illustrating the gripper head assembly, the forearm assembly and the bicep arm assembly in greater detail.

Referring now to the drawings, a pipe handling system according to the invention is illustrated generally at 10 in FIG. 1. The pipe handling system 10 is connected to the structure 11 of a drill rig generally illustrated at 12 by a base plate 40 (FIG. 3) in a manner to be described. The pipe handling system 10 is used to move a tubular such as drill pipe or casing 13 from a horizontal position in the pipe rack 14 (FIG. 1) to a vertical position (FIG. 2) wherein the tubular may be connected to the drill string or previously transferred casing which extends from the well bore or mousehole as will be described in greater detail hereafter.

The pipe handling system 10 comprises four (4) principal components, namely a mounting assembly generally illustrated at 21 which includes the base plate 40 and which is adapted to connect the bicep arm assembly 22 to the structure of the drill rig 12, the bicep arm assembly 22 which is pivotally connected to the mounting assembly 21, a forearm assembly generally illustrated at 23 which is pivotally connected to the bicep arm assembly 22 at axis 25 and which comprises an outer forearm 30 and an inner forearm 31 movable relative to the outer forearm 30 and a gripper head assembly generally illustrated at 21 which is pivotally connected to the forearm assembly 23 by pin joint 26 as will be described in greater detail.

Figure 3:
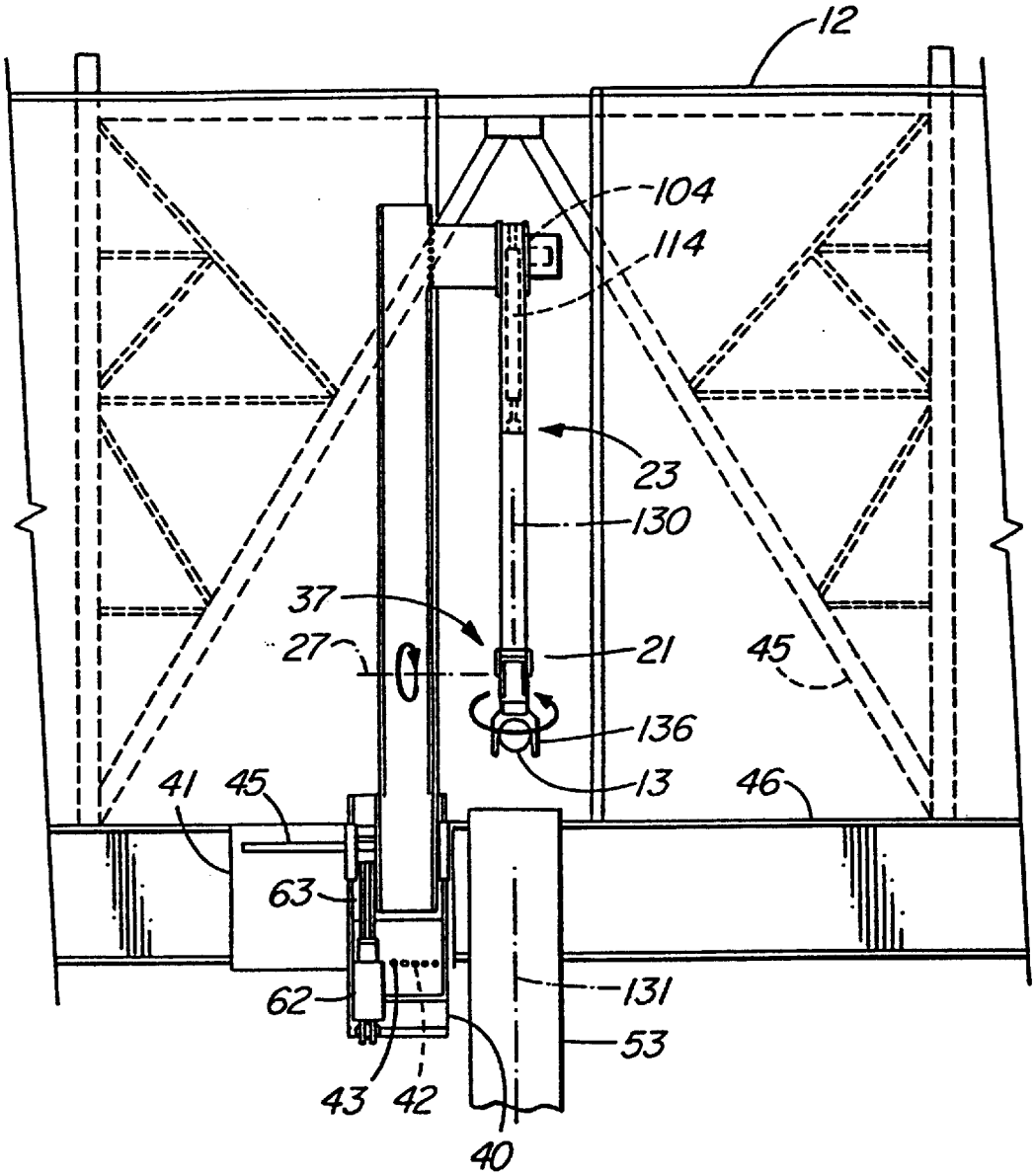
FIG. 3 is a front view of the pipe handling system of FIGS. 1 and 2 particularly illustrating the position of the forearm assembly with the tubular in moving the tubular from the piperack to the drill floor.
Figure 4:
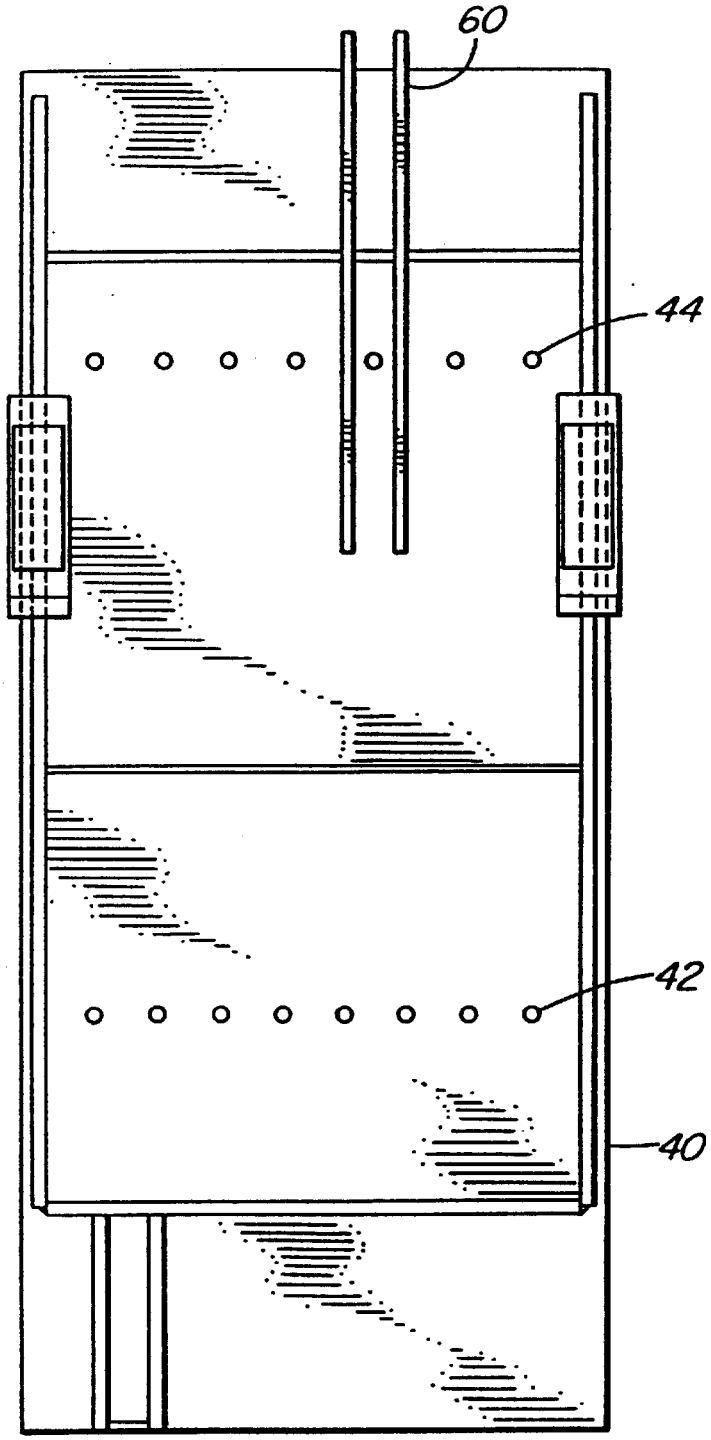
FIG. 4 is a front detail view of the base plate to which is attached the bicep arm assembly and its linear actuator.

The mounting assembly 21 is best illustrated in FIGS. 3 and 4. A base mounting plate 41 is connected to the structure of the drill rig 12. A base plate 40 is mounted thereon for sliding horizontal movement relative to the base mounting plate 41. This is provided by a series of holes 42 extending through the lower end of the base plate 40 and bolts 43 extending through the holes 42 in base plate 40 and into threaded receiver holes 44 in base mounting plate 41. A second series of threaded receiver holes 44 are provided in base plate 40 and a slot 45 is provided in the base mounting plate 41 to allow relative movement between the base plate 40 and the base mounting plate 41. Bolts 51 are adapted to pass through the slot 45 in base plate 40 and are threadedly engaged with the receiver holes 44 in base mounting plate 41. When the bolts 51 between base plate 40 and base mounting plate 41 extending through slot 45 are loosened and the bolts 43 extending through the base plate 40 into the base mounting plate 41 are removed, the base plate 40 may slide horizontally, together with the bicep arm assembly 22, relative to the base mounting plate 41, a distance sufficient to allow the forearm assembly 23 to move to the left and out of the area central of the catwalk 53 as best illustrated in FIG. 3.

A bicep cylinder 54, conveniently a linear actuator, is mounted between the arms 60 of base plate 40 (FIG. 4). The bicep cylinder 54 extends outwardly and connects with the bicep arm bracket 61 as best seen in FIG. 1. Movement of the bicep cylinder 54 will rotate the bicep arm 22 about axis 71 relative to the base plate 40. A second linear actuator 62 is mounted between the base plate 40 and a chain drive or actuator arm 63. The actuator arm 63 is used to provide movement to the chain drive generally illustrated at 70 in a manner as will be more particularly described hereafter.

Figure 5A:
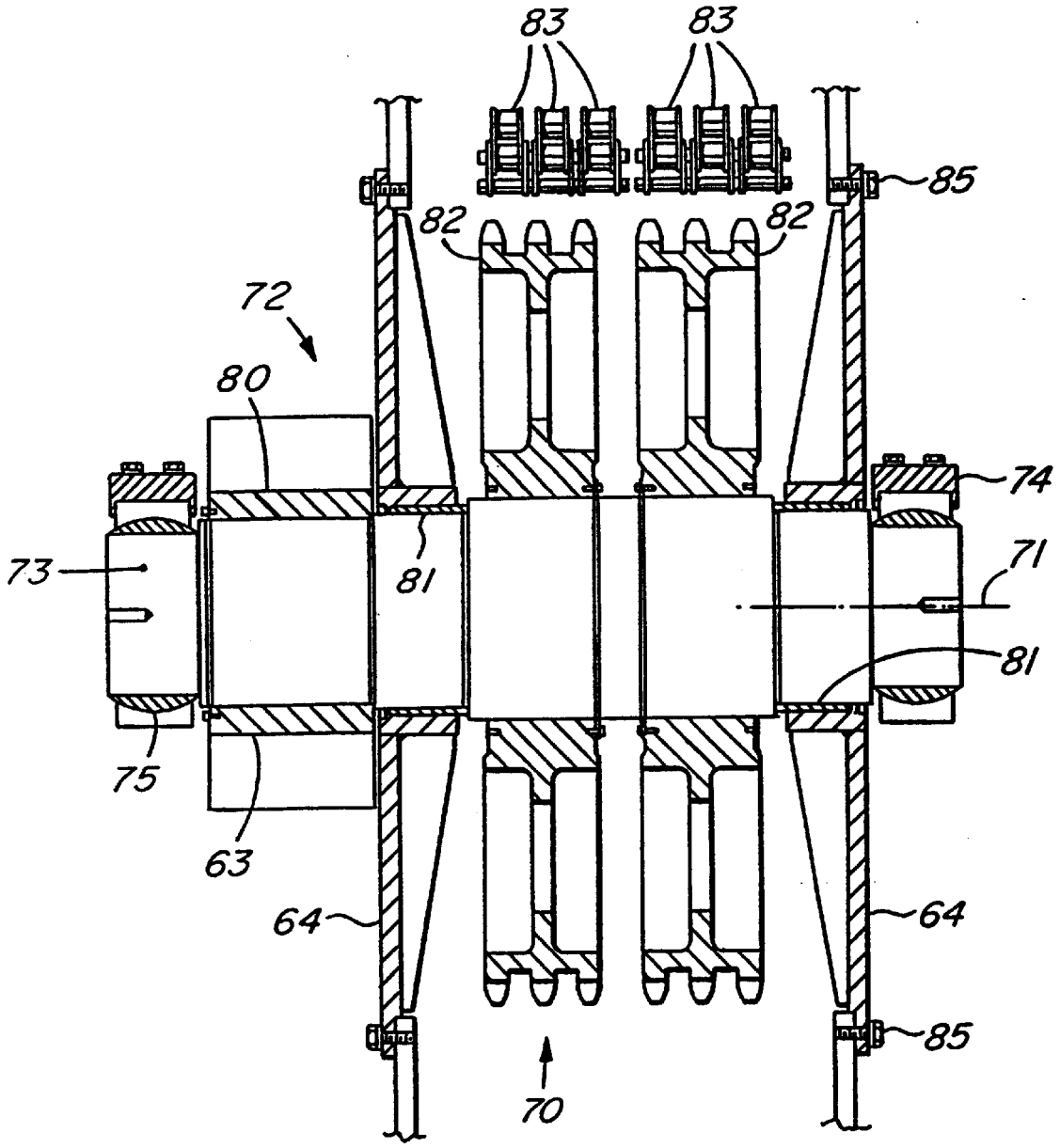
FIGS. 5A and 5B are cutaway assembly views of the main and outer shafts of the bicep arm assembly and their various mounted components.

The main shaft assembly generally illustrated at 72 is illustrated in more detail in FIG. 5A and includes the chain drive 70. The main shaft 73 is mounted on bearings 75 in bearing housings 74 on opposite ends of the base plate 40. A splined hub 80 is mounted to main shaft 73 and carries the actuator arm 63 (FIG. 1) which moves the main shaft 73 under the influence of aforementioned linear actuator 62. Bearing bushings 81 are provided between the housing 64 of the bicep arm assembly 22 which bearings 81 allow rotation of the main shaft 73.

Figure 5B:
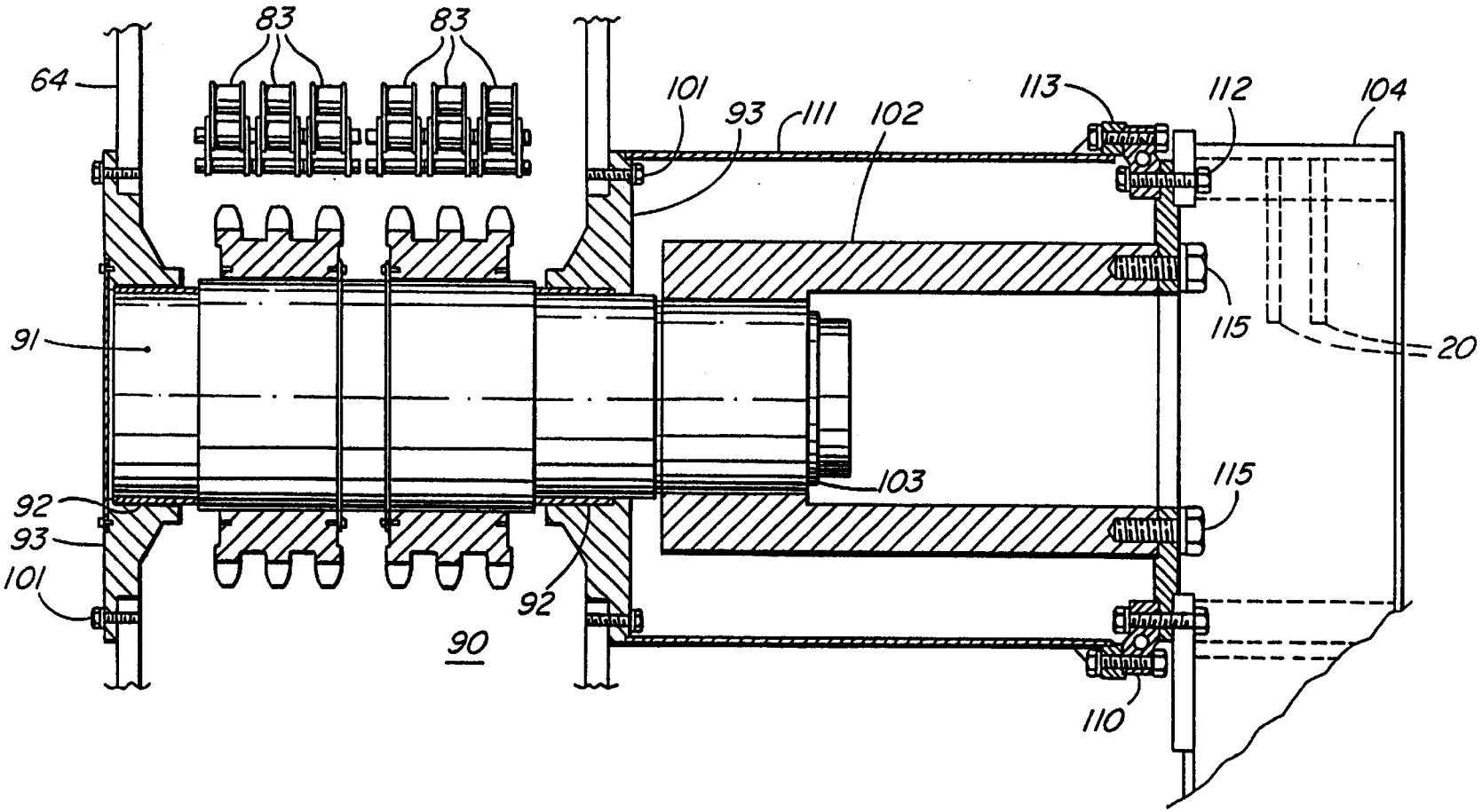

Two sprockets 82 are provided which are keyed to the main shaft 73 and rotate simultaneously therewith when the actuator arm 63 moves the splined hub 80. Chains 83 are mounted to each of the sprockets 82 and extend to sprockets 84 on the outer shaft assembly generally illustrated at 90 in FIG. 5B.

The outer shaft 91 (FIG. 5B) is rotatably mounted between bush bearings 92 located within outer bearing housing 93 and inner bearing housing 94. Each of the bearing housings 93, 94 is mounted to the bicep arm housing 64 by cap screws 101.

Outer shaft 91 has a splined hub 102 mounted thereon which is retained by retaining ring 103. The housing 104 of the outer forearm 30 is connected about the periphery of the splined hub 102 and a slewing ring 110 is provided between the housing 111 extending from inner bearing housing 94 and the outer forearm housing 104 to allow for relative movement therebetween. Hex bolts 112 join the flange 113 of housing 111 to the slewing ring 110 and the slewing ring 110 and outer forearm housing 104, respectively.

Referring again to FIGS. 2 and 3, the forearm assembly 23 includes an outer forearm 30 and an inner forearm 31 which moves longitudinally relative to and within the outer forearm 30 under the influence of a forearm linear actuator 114 connected between bicep arm 22 and inner forearm 31 (FIG. 8) which actuator 114 is located inside outer forearm housing 104 and connected to a bracket 121 connected to the inner end of inner forearm 31. The distant end of inner forearm 31 is pivotally connected to the gripper head assembly 21.

The gripper head assembly 21 is adapted to grasp is and transfer the tubular 13 under the influence of the movement of the bicep arm assembly 22 and the forearm assembly 23. The gripper head assembly 21 includes an upper gripper assembly 170 and a lower gripper assembly 166. The upper gripper assembly 170 includes first and second pins 164, 165, respectively, and the lower gripper assembly 166 includes recesses 167, 168 which are adapted to accommodate the pins 164, 165 when the upper gripper assembly 170 is removably mounted within the lower gripper assembly 166.

Figure 7A:
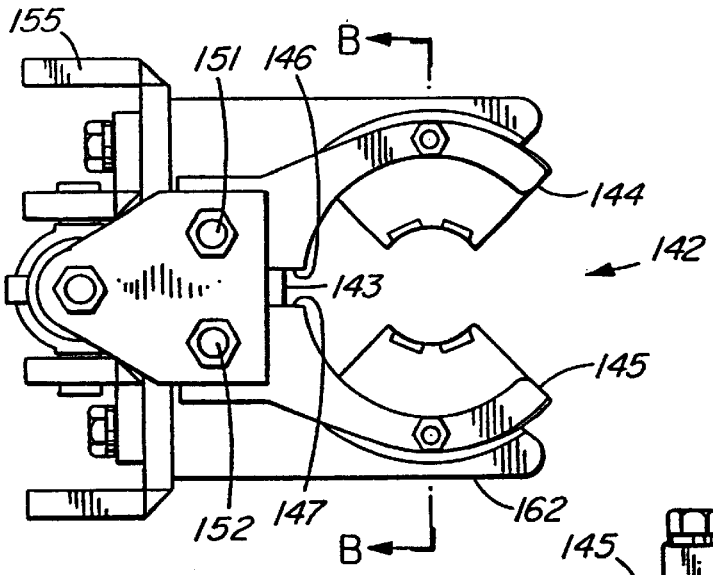
FIG. 7A is a plan view of the taper lock assembly used on the gripper head.
Figure 7B:
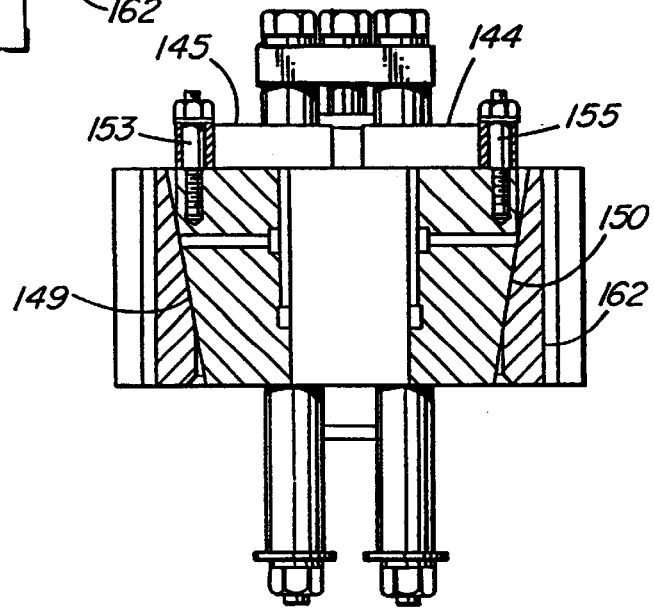
FIG. 7B is a cutaway sectional view taken along B—B of FIG. 7A.
Figure 7C:
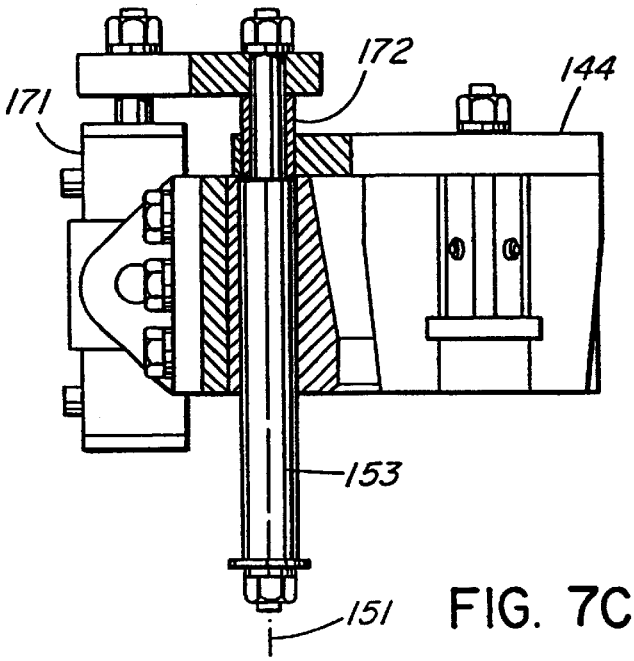
FIG. 7C is a cutaway sectional view taken along C—C of FIG. 7A.

The lower gripper assembly 166 also includes the taper lock assembly 142 (FIG. 7A) and the clamping assembly 136. The taper lock assembly 142 is shown in detail in FIG. 7. It comprises two hanger plates 144, 145, the former being mounted on pin 153 and the latter being mounted on a second pin (not shown). A spring 143 is mounted between the inner surfaces 146, 147 of the hanger plates 144, 145, respectively, in order to open the hanger plates 144, 145 and allow entry of a tubular 13.

Slips 149, 150 are mounted to the hanger plates 145, 144, respectively, by threaded portions of pins 153, 155. The slips 149, 150 are operably located within a slip bowl 162 which is connected to a hanger bracket assembly 155. The slips 149, 150 are adapted to move axially within the slip bowl 162 under the influence of a solenoid operated hydraulic cylinder 171 which provides movement to the slips 149, 150 relative to the slip bowl 162.

Figure 6:
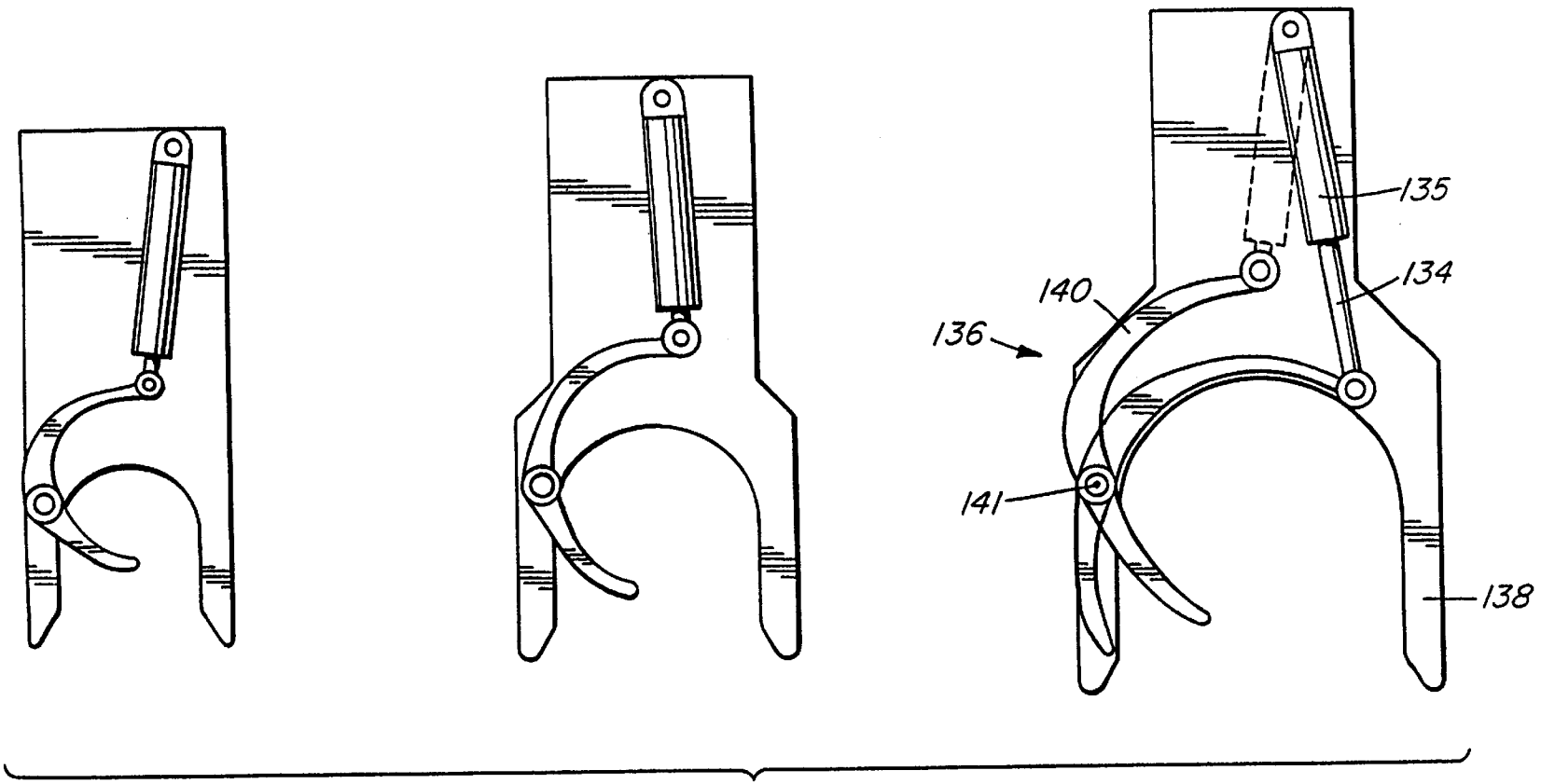
FIG. 6 is a diagrammatic plan view illustrating one latch of the clamping assembly used on the gripper head.

The clamping assembly 136 shown diagrammatically in FIG. 6 includes a solenoid operated hydraulic cylinder 135, a fixed arm 138 and a clamping arm 140. Clamping arm 140 rotates about axis 141 under the influence of hydraulic cylinder 135, the clamping arm 140 closing when the hydraulic cylinder 135 is retracted and the clamping arm 140 opening when the hydraulic cylinder 135 is extended.

Figure 8:
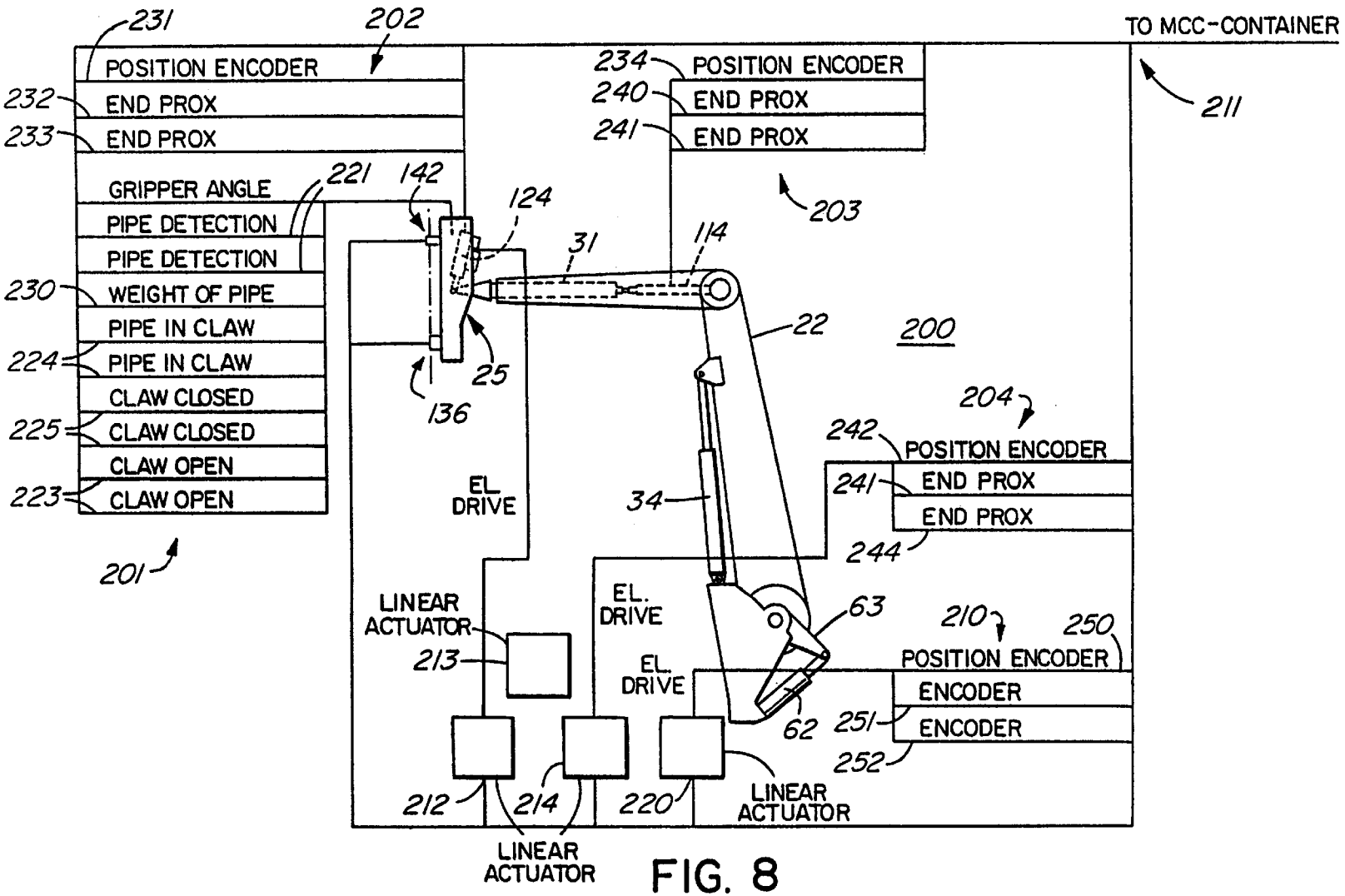
FIG. 8 is a schematic diagram illustrating the sensor and control system of the pipe handling system according to the invention.

Referring now to FIG. 8, the control system is illustrated generally at 200. It comprises a sensor cluster 201 for the gripper head assembly 21, an actuator sensor cluster 202 for the linear actuator 124, an actuator sensor cluster 203 for the linear actuator 114 associated with the inner forearm 31, an actuator sensor cluster 204 for the linear actuator 54 associated with the bicep arm 22 and an actuator sensor cluster 210 for the linear actuator 62 associated with the actuator arm 63 driving the chains 83. All of the sensor clusters 201, 202, 203, 204, 210 are connected through the master controller circuit 211 to the solenoid operated taper lock assembly 142, the clamping assembly 136, a first linear actuator drive unit 212, a second linear actuator drive unit 213, a third linear actuator drive unit 214 and a fourth linear actuator drive unit 220.

The sensor cluster 201 for the gripper head assembly comprises a plurality of pipe detection sensors 221, a gripper angle sensor 222, a plurality of pipe in claw sensors 224, a plurality of claw closed sensors 225, a plurality of claw open sensors 223 and a weight of pipe sensor 230.

The actuator sensor cluster 202 comprises a position encoder 231 and two proximity switches 232, 233. The actuator sensor cluster 203 comprises a position encoder 234 and two proximity switches 240, 241.The actuator sensor cluster 204 comprises a position encoder 242 and two proximity switches 243, 244. The actuator sensor cluster 210 comprises a position encoder 250 and two proximity switches 251, 252.

Operation

In operation, it will be assumed that the pipe handling system 10 has been mounted to the structure 11 of the drill rig 12 by the use of mounting assembly 21 as seen in FIG. 1 such that the longitudinal axis 130 of the forearm assembly 23 is generally located directly above the central and longitudinal axis 131 of the catwalk 53 as seen in FIG. 3 and that the bolts 43, 44 (FIG. 1) between the base plate 40 and the base mounting plate 41 have been appropriately tightened to prevent play or movement between the base mounting plate 41 and the base plate 40. It will further be assumed that the tubulars 13 such as drill pipe or casing located horizontally on pipe rack 14 are located a maximum distance from the structure 11 of the rig 12.

The linear actuator 54 for the bicep arm 22, the linear actuator 114 for the inner forearm assembly 31, the linear actuator 62 used to drive the chain sprockets 82 and, thence, chain 83 and the linear actuator 124 for the gripper head assembly 21 are all previously programmed by the master controller 211 such that angular orientation of bicep arm 22 relative to the mounting assembly 21, the s angular orientation of the forearm assembly 23 relative to the bicep arm 22, the extension of inner forearm 31 relative to the outer forearm 30 of the forearm assembly 23 and the angular orientation of the gripper head assembly 21 relative to the forearm assembly 23 are appropriate to bring the gripper head assembly 21 into proximity with the pipe or casing 13.

As the pipe handling system 10 moves, the sensor clusters 201, 202, 203, 204 and 210 provide the controller 211 with positional information concerning the gripper head assembly 21 by use of the gripper angle sensor 222 and the position encoders 231, 234, 242 and 250. These position encoders 231, 234, 242 and 250 encode the position of the respective linear actuators 124, 114, 54 and 62, respectively. The travel limits of each member are determined by proximity switches 232, 233, 240, 241, which measure the extension of the pistons of the actuators 124, 114, 54 and 62, respectively.

As the gripper head assembly 21 comes into proximity with the tubular 13, it is first detected by the pipe detection sensors 221. The controller 211 will then check the claw open sensors 223 to ensure the taper lock assembly 142 and the clamping assembly 136 are in the open positions.

Based on the information from the pipe detection sensors 221, the gripper angle sensor 222 and position encoders 231, 234, 242 and 250, the controller 211 will activate drive units 212, 213, 214 and 220 toward the tubular 13.

When the tubular 13 is within the taper lock assembly 142 and clamping assembly 136 as indicated by the pipe in claw sensors 224, the controller 211 activates the solenoids of the hydraulic cylinders 135 (FIGS. 2 and 6) of the clamping assembly 136. This will retract the pistons 134 relative to the cylinders 135 and rotate the clamping arms 140 about axis 141 and fit the arms about the pipe or casing 13 thereby to hold it within the circumference of the clamping arm 140 and the fixed arm 138. Likewise, the controller 211 activates the solenoid of the taper lock assembly 142 (FIGS. 2 and 7) such that the taper lock assembly 142 will fit around the circumference of the pipe or casing by means of spring 143 which holds the hanger plates 144, 145 apart and which rotate about axis 151 of pin 153 and axis 152 of a second pin (not illustrated), respectively.

The claw closed sensors 225 will indicate when the tubular 13 is fully within the taper lock assembly 142 and the clamping assembly 136.

The controller 211 then activates the drive units 212, 213, 214 and 220 and moves the pipe 13 as instructed by the controller 211 based on the weight of pipe sensor 230, the gripper angle sensor 222, the position encoders 231, 234, 242 and 250 and the proximity switches.

As viewed in FIG. 8, the pipe or casing 13 will be moved leftwardly, the box end 154 being movable forward first up the catwalk 53 without coming into contact therewith through the V-door 45 (FIG. 1) of the rig 12 and over the drill floor 46 to its final vertical position where its longitudinal axis is coincident with the axis 160 of the well bore.

The hydraulic cylinder 171 (FIG. 7) will then be activated to move the slip 150 relative to the slip bowl 162 and thereby release the pipe or casing 13 held therein. The hydraulic cylinders 135 (FIGS. 2 and 6) are likewise activated so that piston 134 is extended thereby opening clamping arms 140 and allowing release of pipe 13. The gripper head assembly 21 is then moved away from the vertical standing pipe or casing 13 and back to the pipe rack 14 in order that a further pipe or casing 13 may be obtained and placed in the vertical position as described.

The process may, of course, be reversed; that is, the pipe handling system 10 may be used to move pipe or casing 13 from the vertical position on the axis of the well centre 160 into the horizontal position where it can be positioned on the pipe rack 14. In this event, the various linear actuators and hydraulic cylinders are programmed by the operator to accommodate the reverse process.

The gripper head assembly 21 is designed to accommodate the change in diameters of tubulars 13 and may be used with drill pipe and casing of various diameters. In the event a change in the pipe or casing size is required, the gripper head assembly 21 is designed to allow a change in the clamping assembly 136 and the taper lock assembly 142. To this end, reference is made to FIG. 2 wherein the lower gripper assembly 166 which includes the taper lock assembly 142 and the clamping assembly 136 is removable from the upper gripper assembly 170 which is connected to the inner forearm 31. A locking pin 163 is manually removed and the recesses 167, 168 of the lower gripper assembly 166 move out of engagement with pins 164, 165 of the upper gripper assembly 170 by moving the inner forearm 31 connected to the gripper head assembly 21. A replacement lower gripper assembly (not shown) can then be connected by moving the inner forearm 31 to a position where the recesses 167, 168 of the replacement gripper assembly are aligned with the pins 164, 165 of the upper gripper assembly 170 and then locking the pins 164, 165 into the recesses 167, 168 with a manually insertable locking pin 163. The replacement lower gripper assembly 166 will then move with the upper gripper assembly 170 and will accommodate pipe sizes different from the pipe sizes accommodated by the initial lower gripper assembly 166.

It is desirable to service tubulars ranging from a minimum outside diameter of 2¾ inch. To that end, it has been found that three lower gripper assemblies are necessary to cover the operating ranges.

Figure 9:
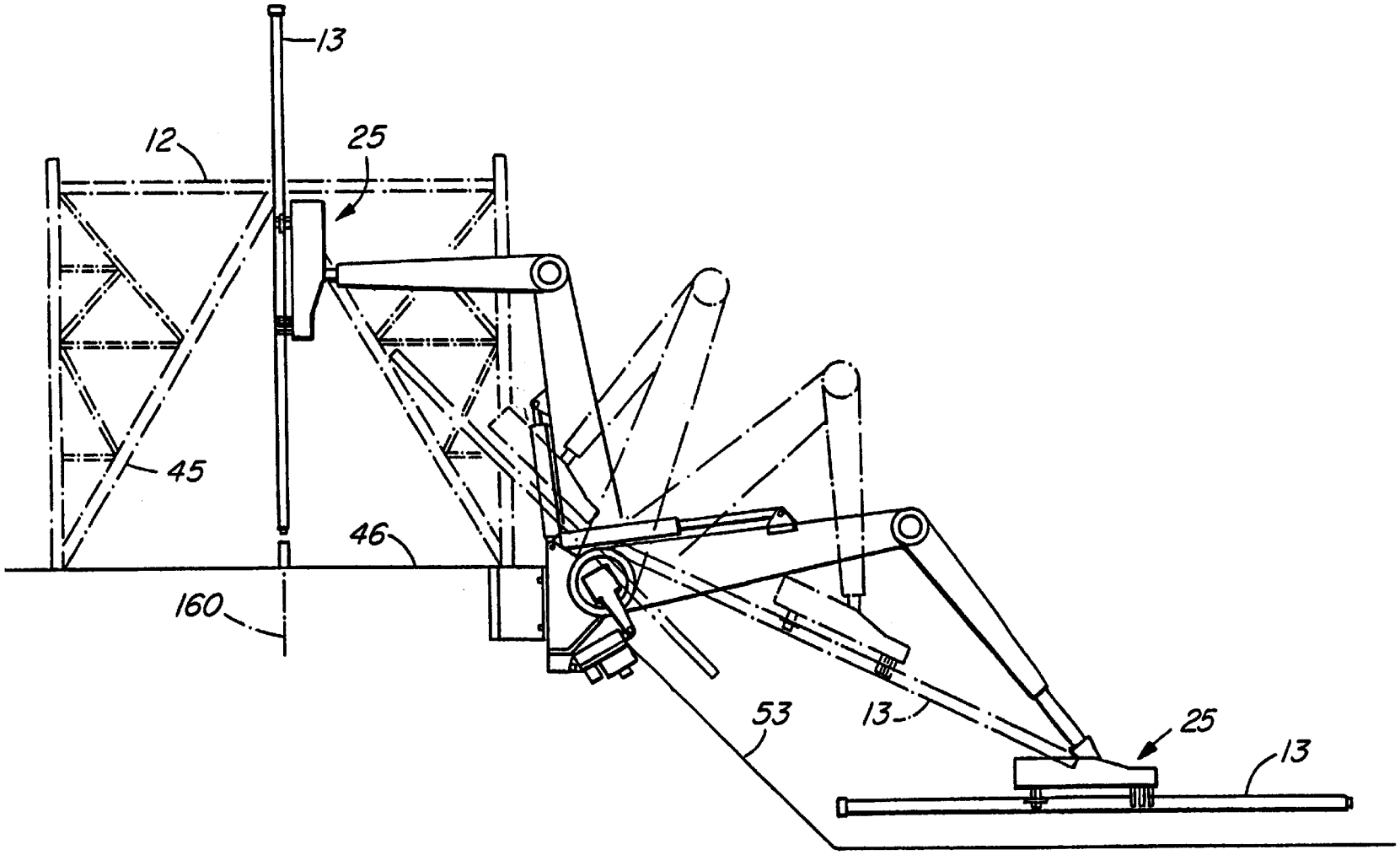
FIG. 9 is a diagrammatic side view of the pipe handling system illustrating the operating sequence of arm and gripper locations in transferring the tubular from the piperack to a vertical position on the drill floor of the rig.

In the event that the pipe handling system 10 breaks down or otherwise becomes inoperable, the conventional cable handling system may be used to reduce or forestall any downtime of the drill rig. To this end, the bolts 43 between the base plate 40 (FIG. 3) and the base mounting plate 41 are removed and the bolts 51 passing between the slot 45 in the base mounting plate 40 and into the base plate 40 are loosened. The base plate 40 is then moved relative to the base mounting plate 41 by use of the slot 45 which allows such movement. As illustrated in FIG. 3, the base plate 40 can be moved leftwardly relative to base mounting plate 41 by the use of slot 45. The forearm assembly 23 will also move leftwardly out of proximity with the catwalk 53 and the centre of the V-door 45 so that the tubulars 13 may be retrieved by the conventional cable system from the horizontal position on piperack 14 to the vertical position on drill floor 46 over the well bore axis 160 (FIG. 9). When the pipe handling system 10 is repaired or otherwise put back into service, the operation is reversed; that is, the base plate 40 will be moved horizontally relative to base mounting plate 41 until the forearm assembly 23 is again aligned with and over the axis of the catwalk 53. The bolts 51 are secured and the bolts 42 are inserted and secured. The pipe handling system 10 will again be operable as described.

It is likewise a relatively simply operation to replace the bicep arm 22 illustrated in FIG. 1 and the forearm assembly 23 with members having an extended length shorter or longer than the lengths illustrated depending on the configuration of the rig and the position of the pipe rack which holds the pipe or casing 13. In this regard, reference is made to FIGS. 5A and 5B where the capscrews 85 can be removed which will thereby allow the housing 64 of the bicep arm 22 to be removed. Likewise, it is relatively convenient to remove the hex bolts 112 and the cap screws 115 in order to allow the outer forearm housing 104 and the inner forearm 31 to be removed and replaced. The length of the chains 83 will be appropriately adjusted in this event by removing or adding the necessary links.

It is also intended that the pipe handling system 10 move the pipe or casing 13 from a horizontal to a vertical position not in line with the well centre but in line with a mousehole (not illustrated) located a relatively short distance away from the well centre. The mousehole is a vertical, elongate cylindrical container adjacent the rotary table of the drill floor which is used to separate the pipe temporarily and is used to form drill strings prior to inserting such drill strings into the well bore.

Likewise, if the mouse hole is inclined, it is contemplated that by giving the gripper head assembly 21 a further degree of movement such as by providing a second axis of rotation 27 at right angles to the axis of rotation of pin joint 26 as illustrated at 37 in FIG. 3, the tubular 13 could be inclined as desired to coincide with the off-centre axis of the mousehole.

Many further embodiments will readily occur to those skilled in the art to which the invention relates and the specific embodiments described should be taken as illustrative of the invention only and not as limiting its scope as defined in accordance with the accompanying claims.

What is claimed is:

1. A pipe handling system for a drill rig having a V-door, said pipe handling system comprising a bicep arm assembly pivotally connected to a base plate, a forearm assembly pivotally attached to a distant end of said bicep arm assembly, and a gripper head pivotally connected to a distant end of said forearm assembly, said base plate and said bicep arm assembly being mounted to the structure of said drill rig such that said forearm assembly and said gripper head are operable to move tubulars from a piperack into a position above the drill floor of said drill rig, said base plate being detachably mounted to said bicep arm assembly, said base plate being removably connected to and relatively movable with a base mounting plate attached to said structure of said drill rig, said forearm assembly and said gripper head assembly being movable to transfer said tubulars from said piperack to said drill floor through said V-door of said drill rig.

2. A pipe handling system as in claim 1 wherein said gripper head assembly transfers one of said tubulars to said drill floor substantially centrally and above a catwalk of said drill rig.

3. A pipe handling system as in claim 2 wherein said base plate and said base mounting plate are operable to move said gripper head and forearm assembly from said position substantially centrally and above said catwalk to a second position adjacent said catwalk.

4. A pipe handling system as in claim 1 wherein one of said base plate and base mounting plate have a longitudinal slot, the other of said base plate and said base mounting plate having threaded connections for the insertion of attachment bolts which extend through said longitudinal slot.

5. A pipe handling system comprising a bicep arm assembly, a forearm assembly pivotally connected to said bicep arm assembly, a gripper head assembly pivotally connected to said forearm assembly and means for mounting said bicep arm assembly to the structure of a drill rig, said mounting means comprising a base plate attached to a base mounting plate, said base plate being operable to move with said bicep arm assembly, said forearm assembly and said gripper head assembly relative to said base mounting plate.

* * * * *